US005277560A

United States Patent [19]

Ritchie et al.

[11] Patent Number: 5,277,560

[45] Date of Patent: Jan. 11, 1994

[54] RING VALVE TYPE AIR COMPRESSOR WITH DEFORMABLE RING VALVES

[75] Inventors: Nathan Ritchie, Columbus; Dan L. Streutker, Madison, both of Ind.

[73] Assignee: Holset Engineering Company, Inc., Columbus, Ind.

[21] Appl. No.: 897,740

[22] Filed: Jun. 18, 1992

Related U.S. Application Data

[63] Continuation-in-part of Ser. No. 721,035, Jun. 26, 1991, Pat. No. 5,213,487.

[51] Int. Cl.[5] ..... F04B 21/02

[52] U.S. Cl. ..... 417/564; 417/567; 137/852

[58] Field of Search ..... 417/571, 564, 563, 567; 137/512.3, 516.15, 852

[56] References Cited

U.S. PATENT DOCUMENTS

| | | | |
|---|---|---|---|
| 1,001,305 | 8/1911 | Rix | 417/564 |
| 1,476,794 | 12/1923 | Berry | 137/512.3 |
| 2,382,717 | 8/1945 | Merzmark | 417/254 |
| 2,556,623 | 6/1951 | Lipkau | 417/295 |
| 2,613,870 | 10/1952 | Borgerd | 137/512.3 |
| 2,728,351 | 12/1955 | Cooper | 137/516.15 |
| 3,050,237 | 8/1962 | Nicholas | 417/564 |
| 3,786,834 | 1/1974 | Garland | 137/540 |
| 4,249,564 | 2/1981 | Gelse et al. | 137/516.15 |
| 4,906,174 | 3/1990 | Olsson | 137/852 |
| 5,022,832 | 6/1991 | Lauterbach et al. | 417/571 |

FOREIGN PATENT DOCUMENTS

| | | | |
|---|---|---|---|
| 543952 | 9/1922 | France | 137/512.3 |
| 823835 | 1/1938 | France | 137/512.3 |

*Primary Examiner*—Richard A. Bertsch
*Assistant Examiner*—Peter Korytnyk
*Attorney, Agent, or Firm*—Woodard, Emhardt, Naughton, Moriarty & McNett

[57] ABSTRACT

A ring valve assembly for use in a reciprocating type fluid pump with a piston cylinder and a cylinder head includes a ring valve having a fluid seal surface for selectively closing a fluid passage of a cylinder head and an annular ring retainer having a fulcrum edge and tapered top surface. The retainer is positioned beneath the ring valve and a slight clearance is designed in such that the ring valve experiences as a first stage of movement/deflection slight vertical travel. Continued operation of the fluid pump results in a second stage of deflection where the ring valve deflects into a frustoconical shape and lays against the tapered surface of the retainer, pivoting about the fulcrum edge.

16 Claims, 9 Drawing Sheets

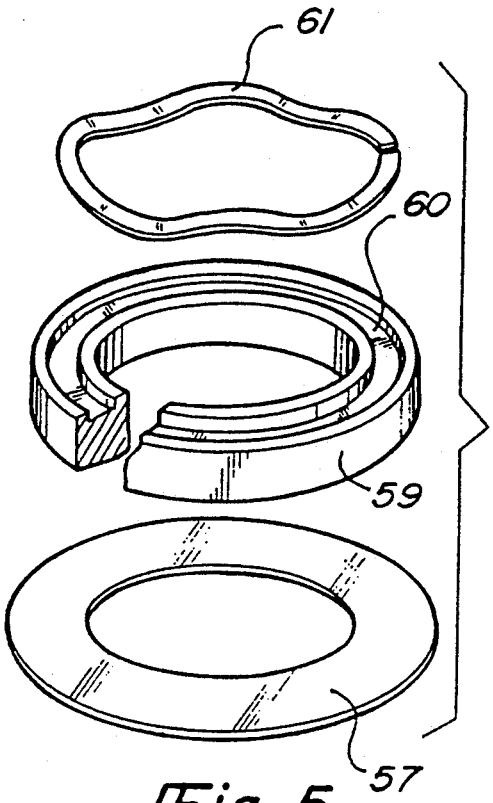
Fig-5
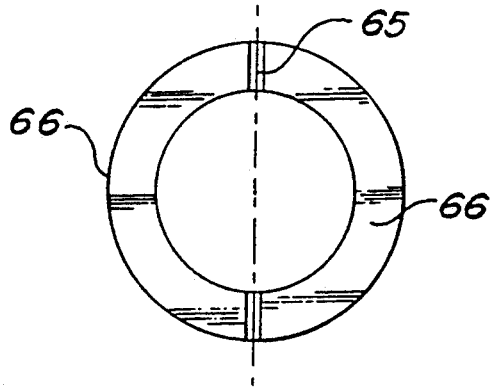
Fig-6
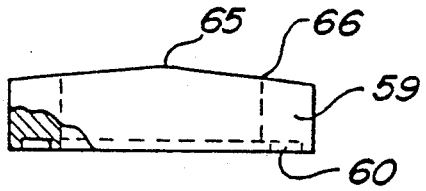
Fig-7
Fig-8
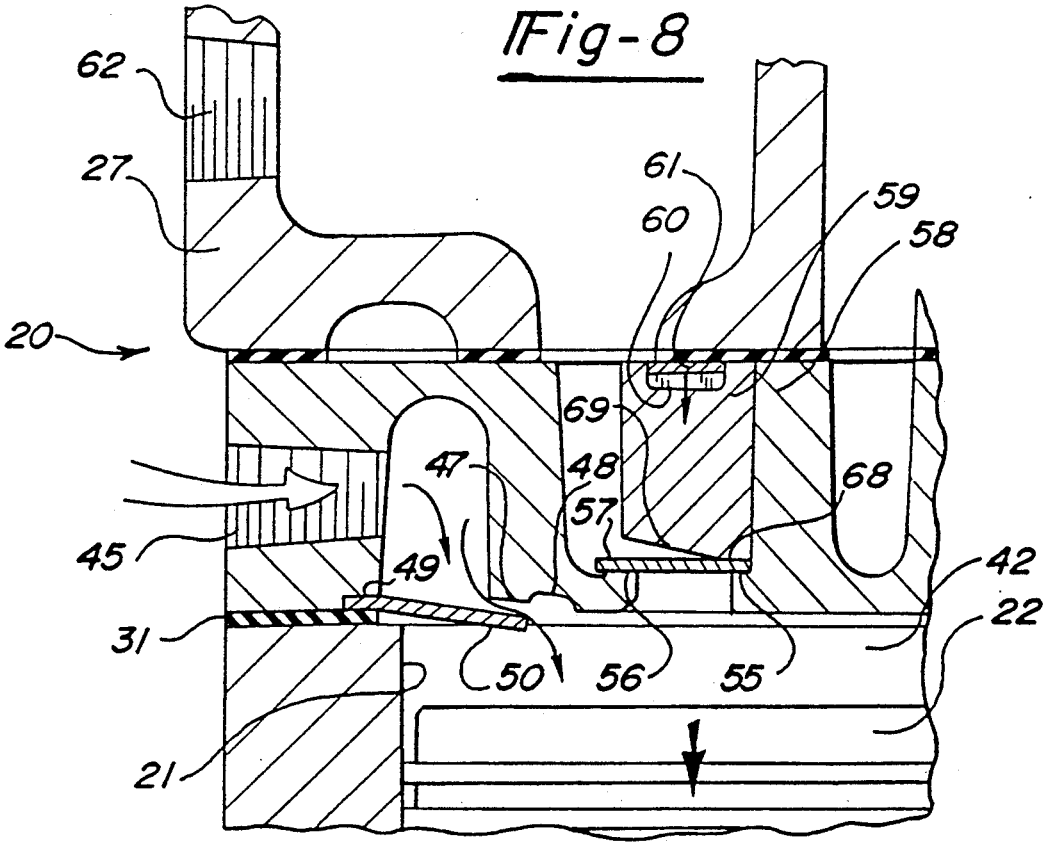

RING VALVE TYPE AIR COMPRESSOR WITH DEFORMABLE RING VALVES

REFERENCE TO RELATED APPLICATIONS

The present patent application is a continuation-in-part patent application of a prior, co-pending application, Ser. No. 07/721,035, filed Jun. 26, 1991, now U.S. Pat. No. 5,213,487, and commonly owned by the same assignee.

BACKGROUND OF THE INVENTION

The present invention relates generally to valves for controlling fluid flow that operate to permit and disrupt fluid flow automatically, and more particularly to ring-type valve structures used as air inlet valves and exhaust valves in high pressure gas compressors and fluid pumps. Specifically, the present invention relates to an improvement in the ring valve structures described in co-pending United States Letters patent application Ser. No. 07/278,225, filed Nov. 30, 1988 by inventors Jerre F. Lauterbach, Nathan Ritchie and Richard F. Miller entitled "RING VALVE TYPE AIR COMPRESSOR", and owned by the assignee of the present application, now issued as U.S. Pat. No. 5,022,832.

Ring type valves per se are well known in the art, and have a wide acceptance in use for air compressors and pumps Basically, these ring type valves are opened and closed by pressure differential on opposite sides of the ring valve. It is also heretofore known to include biasing of spring devices along with such ring valves in order to accurately control valve movement upon a pressure differential which is above the spring force of the spring selected in each case. In this way, the valve is opened or closed only upon reaching a pre-determined pressure differential dependent on the spring properties of the spring chosen and the mass of the valve, wherein the valve action can be predicted. The said U.S. Letters patent application No. 07/728,225 (issued Jun. 11, 1991 as U.S. Pat. No. 5,022,832 was directed to solving certain problems in the prior art as exemplified by constructions such as those shown in Herzmark, U.S. Pat. No. 2,382,716 issued Aug. 14, 1945; Peters, U.S. Pat. No. 1,225,321 issued Apr. 10, 1917; and Garland, U.S. Pat. No. 3,786,834 issued Jan. 22, 1974. Such constructions generally disclose use of spring washers that are freely supported to bias the ring valves in a desired position. This type of spring washer and ring valve assembly requires additional supporting structure to retain the spring washer, which decreases the efficiency of the air compressor by lowering the compression volume of each cylinder at the end of the suction stroke, and increases the cost, weight, and complexity of the valve assembly. The said co-pending U.S. Letters patent application Ser. No. 07/278,225 (Pat. No. 5,022,832) solved those problems of the prior references by providing a biasing means for the ring valve having a peripheral region which is connected to the fluid pump to retain the ring valve between the cylinder head and the bias means, and thus eliminate the additional supporting structure and the decreased efficiency of the prior devices.

However, it has been found that in certain applications, because of air turbulence and the like, some problems have arisen in such improved device, such as the ring valves taking on a "spinning" action, and becoming worn due to resonance conditions causing the ring valve to impact the valve seat with excessive force and becoming dented about the regions of contact between the valve seat and the ring valve, and thus, eventually, causing a leaky condition. Thus, additional improvements and invention are needed to solve those problems.

One approach followed in the patent to Cooper, U.S. Pat. No. 2,728,351, issued Dec. 27, 1955, was to machine the cylinder block and liner with a tapered surface and to position the ring valve such that its deflection into a conical or frustoconical form is limited by the tapered surface. One drawback with this approach is the cost and risk of a machining error which could cause the entire cylinder block and/or liner to become scrap. Another drawback is the size-limited nature of the ring valve. As the cylinder bore size changes the ring valve must change so that its size matches the size of the tapered surface which changes as the bore size changes.

In one embodiment of the present invention the first drawback is overcome by the use of a separate retainer. The retainer provides the tapered surface to be used as a back up for the ring valve deflection, but is a lower cost piece that does not require special machining of the cylinder block and liner. If a machining error is made in the retainer, a lower cost part is scrap and the cylinder block and liner are not affected. In the present invention the same retainer can be used with differently sized bores, such as a 3⅝" bore as well as a 3⅞" bore. Thus greater versatility is provided by the present invention.

SUMMARY OF THE INVENTION

A solution to some of the problems discussed above is achieved in one embodiment of the present invention by providing a ring valve assembly which essentially no longer has external spring biasing means, but could be said to have what can be referred to as "internal" spring biasing means, i.e., a bias that depends on the property of the ring valve itself. This is achieved by physically constraining the inner or outer peripheral edge of the ring valve between opposing faces, with a small clearance, if desired, and having the ring valve deform during operation into the shape of a cone. By providing for a multiple stage deflection of the ring valve, the desired "stiffness" can be obtained without the use of complicated valve shapes. In a related embodiment of the present invention a retainer with a tapered surface is used as a back-up to the ring valve deflection.

Ring valves having their peripheral edges restrained are known in the field of air compressors, such as issued U.S. Pat. Nos. 2,728,351 and 3,112,064. They are also known from Austrian patent no. A2145/69-1 and Austrian patent application no. 871336.

However, the ring valves shown in these prior publications are generally of very complicated and difficult to manufacture shapes, and provide for only limited deflection and/or require backing plates to restrain their movements, thus presenting problems of their own in use. In one embodiment of the present invention the ring valve requires no backing plate and no complicated shapes to provide a wide range of deflections and stiffness. What is used in this one embodiment is a simple annularly shaped ring valve with multiple stages of deflection. In another embodiment a separate retainer is used with a tapered surface which provides a back-up to ring valve deflection.

Thus it is an objection of the present invention to provide a fluid pump device, such as an air compressor, that has an increased volumetric efficiency and durability, while at the same time reducing cost, weight and complexity.

It is a further object of the present invention to provide a valve assembly for an air compressor wherein external spring biasing means are eliminated.

It is still a further object of the present invention to provide a ring valve assembly for an air compressor wherein the ring valves undergo different stages of movement and deflection during operation.

Further objects and advantages of the present invention will be apparent from the following description and appended claims, reference being made to the accompanying drawings forming a part of the specification, wherein like reference characters designate corresponding parts and several views.

BRIEF DESCRIPTION OF THE DRAWINGS

FIG. 5 is a diagrammatic view showing a ring valve and valve retainer assembly as used in the present invention.

FIG. 6 shows a modification of the valve retainer shown in FIG. 5.

FIG. 7 is an elevational view of the valve retainer shown in FIG. 6 taken along line 7—7 of FIG. 6.

FIG. 8 is a further enlarged view of the cylinder head shown in FIG. 2 showing the operation of the ring valves of the present invention at the beginning of the intake stroke of a fluid pump embodying the present invention.

Figure 1:
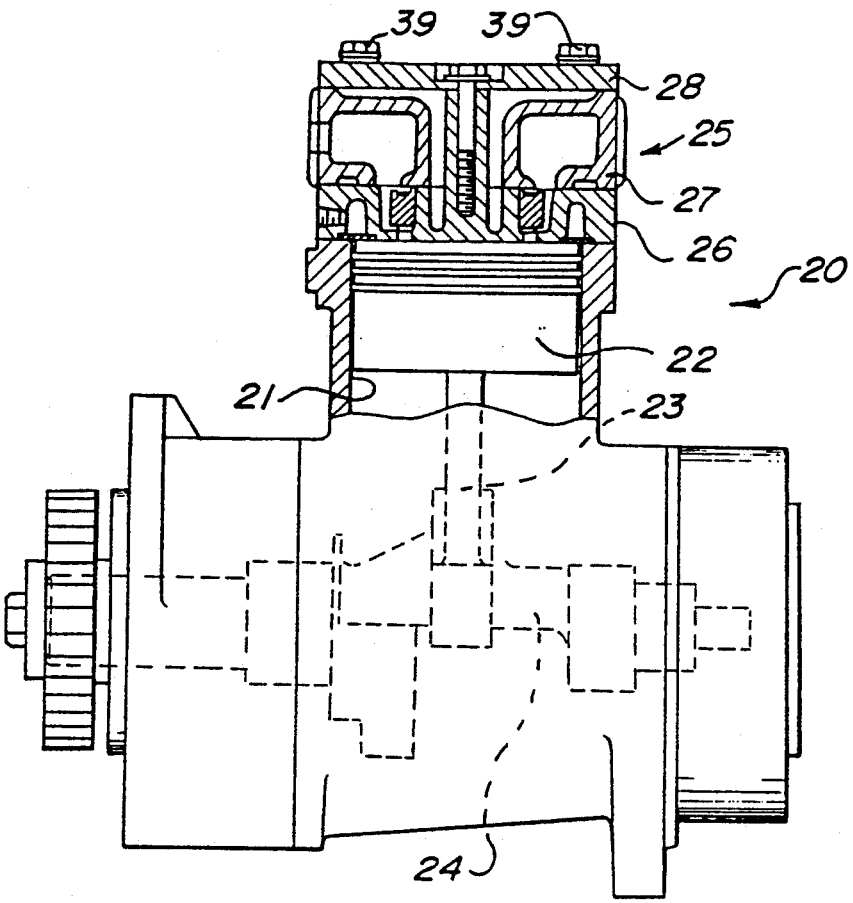
FIG. 1 is an elevational view, partially cut away, of a ring valve type air compressor embodying the present invention.

It is understood that the present invention is not limited to the details of construction and arrangement of parts illustrated in the accompanying drawings, since the invention is capable of other embodiments, and of being practiced or carried out in various ways within the scope of the claims. Also, it is to be understood that the phraseology and terminology used herein is for the purpose of description, and not of limitation.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
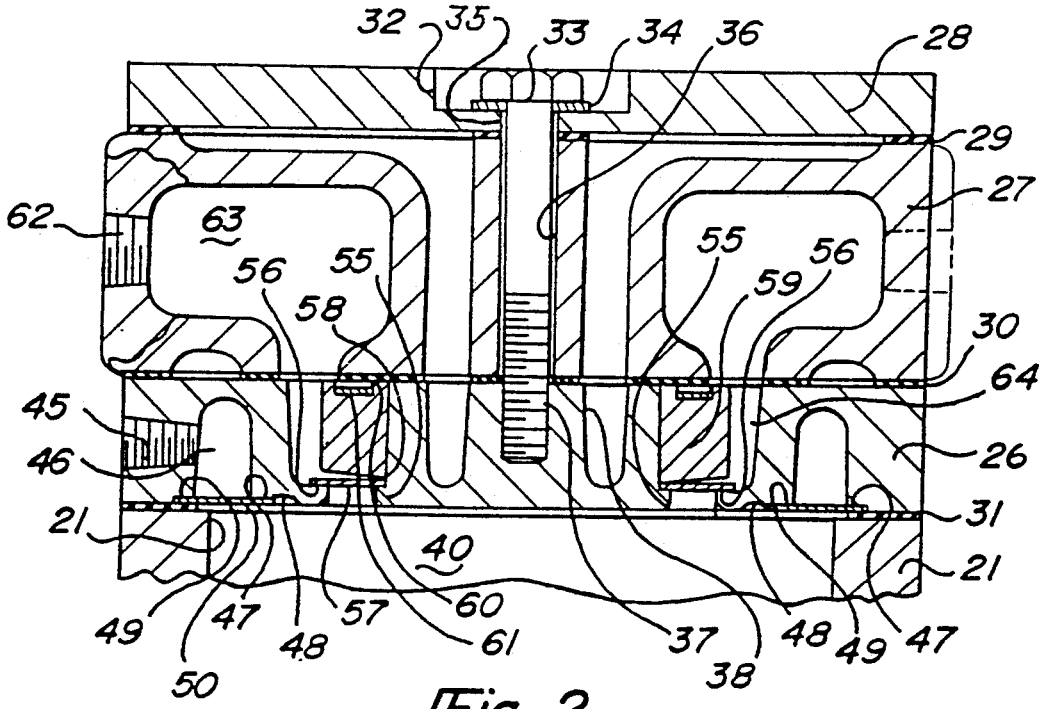
FIG. 2 is an enlarged view of the cylinder head of the ring valve type air compressor shown in FIG. 1.

With reference to the drawings, and more particularly FIGS. 1 and 2, there is illustrated a valve assembly forming a portion of an air compressor or fluid pump. It should be understood that, even though the description herein will deal mainly with an air compressor, the valve assembly can be used on any similar type fluid pump. Also, the valve assembly, while shown in a horizontal orientation, may be oriented differently and still be well within the scope of the present invention.

Shown is a reciprocating type air compressor 20 having a piston cylinder 21 in which is mounted for reciprocation a piston 22 connected to a connecting rod 23 which, in turn, is connected to a crankshaft 24 to change the reciprocating motion of the piston 22 into a rotary motion of the crankshaft 24.

Closing the top of the piston cylinder 21 is the cylinder head, generally designated by the numeral 25 which, in a typical installation, consists of the compressor valve body 26, which has sealing surfaces (valve seat means) for the ring valves hereinafter described, the compressor head 27, and the cover plate 28. A cover plate gasket 29 is provided to seal the cover plate 28 to the compressor head 27. A head gasket 30 provides for the sealing connection of the compressor head 27 to the compressor valve body 26, while the valve body gasket 31 provides for a sealing connection of the compressor valve body 26 to the top of the piston cylinder 21.

The cover plate 28 is fastened to the compressor valve body 26 by means of the bolt 33 first being passed through the washer 34 and then through the hole 35 provided in the cover plate 28. It is then passed through the second hole 36 provided centrally of the compressor head 27 and into the threaded opening 37 provided in the center post section 38 of the compressor valve body 26. When the bolt 33 is tightened, both the cover plate 28 and the compressor head 27 are sealingly fastened to the compressor valve body 26. A recess 32 is provided in the cover plate 28.

The compressor valve body 26 is in turn fastened to the top of the piston cylinder 21 by the head bolts 39 which, for ease of illustration, are only shown in FIG. 1.

It can be seen that the piston cylinder 21, the piston 22 and the cylinder head 25 define a fluid chamber, more particularly a gas compression chamber 40, the volume of which is varied by movement of the piston 22.

The compressor head 27, together with the compressor valve body 26, define air flow passages for air intake and exhaust. At least one air intake 45 is provided in compressor valve body 26 which opens into a gallery 46, also formed in compressor valve body 26, which provides an annular channel for air distribution on the bottom face of the compressor valve body 26. The gallery 46 is further defined on the bottom face of the compressor valve body 26 by an inner circular ridge 47 and an outer circular ridge 49. A relief area 48 is provided immediately adjacent inner circular ridge 47. The inner and outer circular ridges 47 and 49 together serve as a valve seat for the intake valve comprised of ring valve 50.

As can be seen, the outer circular ridge 49 overlaps the piston cylinder 21 and the valve body gasket 31 and thus the outer peripheral edge of ring valve 50 is clamped in place or constrained between a first pair of opposing annular surfaces formed by the valve body gasket 31 and the compressor valve body 26. As will be discussed hereinafter, in one modification of the invention, there is a clearance between the ring valve 50 and the outer circular ridge 49 which allows the ring valve 50 to pivot slightly before beginning to deform. This will be explained in more detail in connection with FIGS. 13–16.

In a similar manner, on the top face of the compressor valve body 26 is provided with a second inner circular ridge 55, and a second outer circular ridge 56, which together serve as a second valve seat means for the second ring valve 57. The dimensions of the second inner circular ridge 55 and the inside dimension of the second ring valve 57 are such that the second ring valve may slip over an annular post portion 58 of the compressor valve body 26 and come to rest on said second inner circular ridge. The second ring valve is thereby constrained by a second pair of opposing annular surfaces formed by valve retainer 59 and the second inner ridge 55. In the case of the second ring valve 57, it is the inner peripheral edge of the ring valve which is held in place by the valve retainer 59 which is mounted over the top of the second ring valve 57 on the annular post portion 58. There may be provided a slight clearance between the top of the valve retainer 59 and the compressor valve body 26 to allow for a slight movement under certain operating conditions when resonance might otherwise be a problem.

To keep sufficient pressure on the second ring valve 57, so that it will deform into a cone during the exhaust stroke of the fluid pump to be hereinafter described, the valve retainer 59 must exert sufficient pressure thereon to enable it to do so. An annular recess 60 (see FIG. 5) is provided on the top of the valve retainer 59 and a wave washer 61 acts between the cylinder head 27 and the valve retainer 59 to keep sufficient pressure on the second ring valve 57. As with the intake valve, there may be a clearance between the valve retainer 59 at its lower most position and the top of the exhaust valve 57 which allow the exhaust valve 57 to pivot slightly before beginning to deform. This also will be shown in more detail in connection with FIGS. 13–16.

An exhaust 62 is provided in the compressor head 27 which is in communication with an exhaust gallery 63 which is in communication with the circular passageway 64 formed above the second ring valve 57 between the wall of the upper surface of the compressor valve body 26 and the valve retainer 59.

Figure 9:
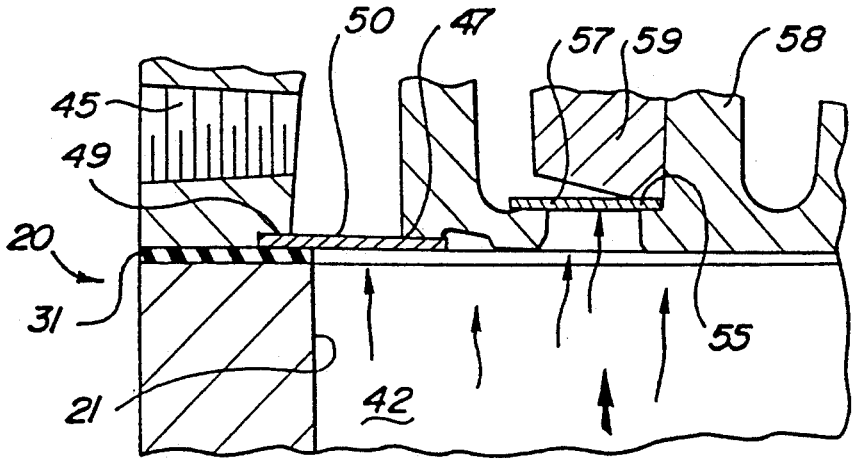
FIG. 9 is a view of the fluid pump shown in FIG. 8 at the point where the fluid pump of the present invention has just started its compression stroke.
Figure 10:
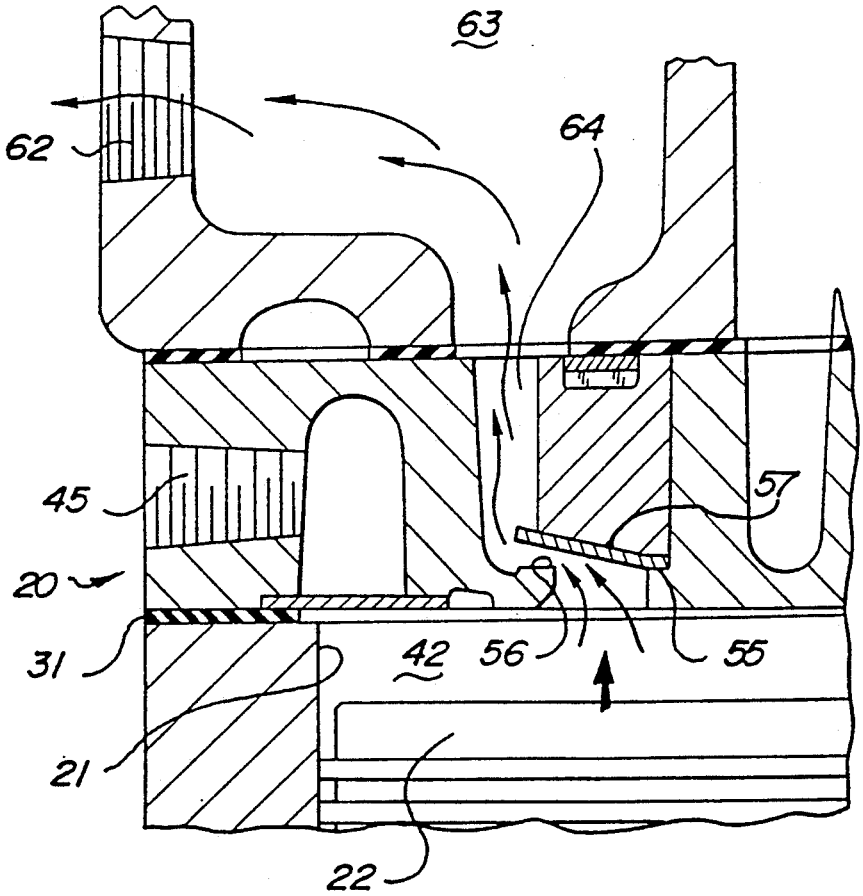
FIG. 10 is a view of the fluid pump shown in FIGS. 8 and 9 when said pump is near the top of its compression stroke, the intake ring valve has closed, and the exhaust ring valve has opened.

Referring now to FIGS. 8–10, the operation of the improved ring valve air compressor can be seen. For ease of illustration, any clearances between the ring valves and the compressor valve or valve retainer have been omitted from these figures. FIG. 8 shows the compressor 20 with the piston 22 at the top of the stroke just starting the intake stroke of the compressor. The downward stroke of the piston 22 causes enough suction to cause the ring valve 50 to deform downwardly into a cone shape, and provide an opening between the ring valve 50 and the inner circular ridge 47 through which air or fluid can pass. This allows air entering the intake 45 to pass by the ring valve 50 into the compression chamber 40. Since the second ring valve 57 is on the upper face of the compressor valve body 26, the suction against the second ring valve 57 just forces it additionally against the second inner circular ridge 55 and the second outer circular ridge 56 and keeps the second ring valve or exhaust valve 57 sealed. As the piston 22 continues down to the bottom of its stroke, the compression chamber 40 is completely filled with air.

Now referring to FIG. 9, the piston 22 (not shown in this view) is just starting its upward stroke. This causes sufficient displacement of the air in the compression chamber 40 to cause the intake valve 50 to move upwardly and seat against the inner circular ridge 47, preventing air from escaping back out the intake 45. Air continues to compress until, as shown in FIG. 10, the air reaches a sufficient pressure to cause the exhaust valve 57 to open. The dimensions of the first and second ring valves, as well as the materials which they are made from, will be carefully chosen depending upon the application to ensure the proper relationship between the opening of the intake or ring valve 50 and the opening of the second ring valve or exhaust valve 57. Even if made of the same materials, because of the much smaller surface area presented to the air by the second ring valve 57, the air will have to be compressed to a much higher pressure to cause the second ring valve 57 to open compared to the only slight suction that was needed to open the ring valve 50. Once the second ring valve 57 opens, air is free to pass out of the compression chamber 40, through the circular passageway 64, and out the gallery 63 to the compressor exhaust 62 (see FIG. 2).

Figure 11:
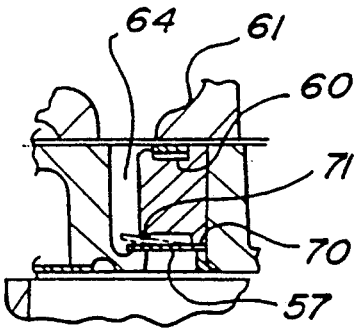
FIG. 11 shows a further modification of the valve retainer shown in FIG. 5.
Figure 12:
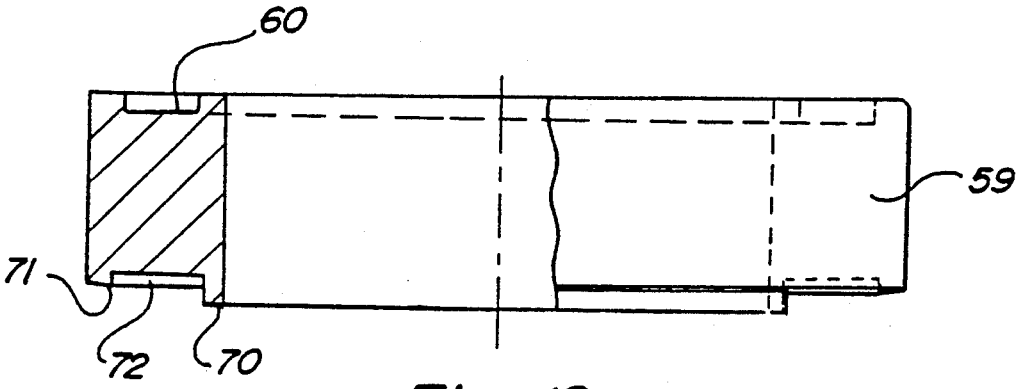
FIG. 12 is an enlarged view of the modified valve retainer shown in FIG. 11.

FIGS. 5 and 8–10 show the preferred embodiment of the ring valve retainer 59, while FIGS. 6 and 7 show a modification thereon, and FIGS. 11 and 12 taken together show a further modification of the ring valve retainer 59.

The preferred embodiment of the valve retainer 59, shown in FIG. 8, has an annularly shaped flat portion 68 substantially identical in radial dimension to the second inner circular ridge 55 to retain the inner peripheral surface of the ring valve 57 in the manner hereinbefore described. The balance of the lower surface of the ring valve retainer 59 is a tapered surface 69 allowing the ring valve to deform in the shape of a cone upon the application of air pressure.

The modification of the valve retainer shown in FIGS. 6 and 7, and still indicated by the numeral 59, has a recess 60 identical to that in all the other versions of the valve retainer. However, instead of having a completely tapered surface, it has a radially extending flat 65 provided on the lower surface through a diameter thereof, with the remainder of the lower surface 66 then being more or less V-shaped, as viewed in FIG. 7, so instead of deforming into a cone upon the application of air pressure thereto, the ring valve 57 will deform into a "V".

The modification shown in FIGS. 11 and 12, instead of having the flat surface 65 together with a "V" shaped surface 66, has an inner, annular, flat surface 70 and an outer annular surface 71. The difference in dimension between the inner, annularly shaped, flat 70 and the outer annular surface 71 is such that the ring valve 57 still forms into a cone shape upon the application of pressure thereto, but in this case, the recess 72 allows for pressure relief.

In order that the improved ring valve type air compressor disclosed in the present application may be used in an air compressor unloader system such as that disclosed in U.S. Pat. No. 4,993,922, issued Feb. 19, 1991, entitled "AIR COMPRESSOR UNLOADER SYSTEM" and assigned to the assignee of the present application. An unloader device, as shown in FIGS. 3 and 4, is provided for the intake valve of a compressor embodying the present invention.

Figure 3:
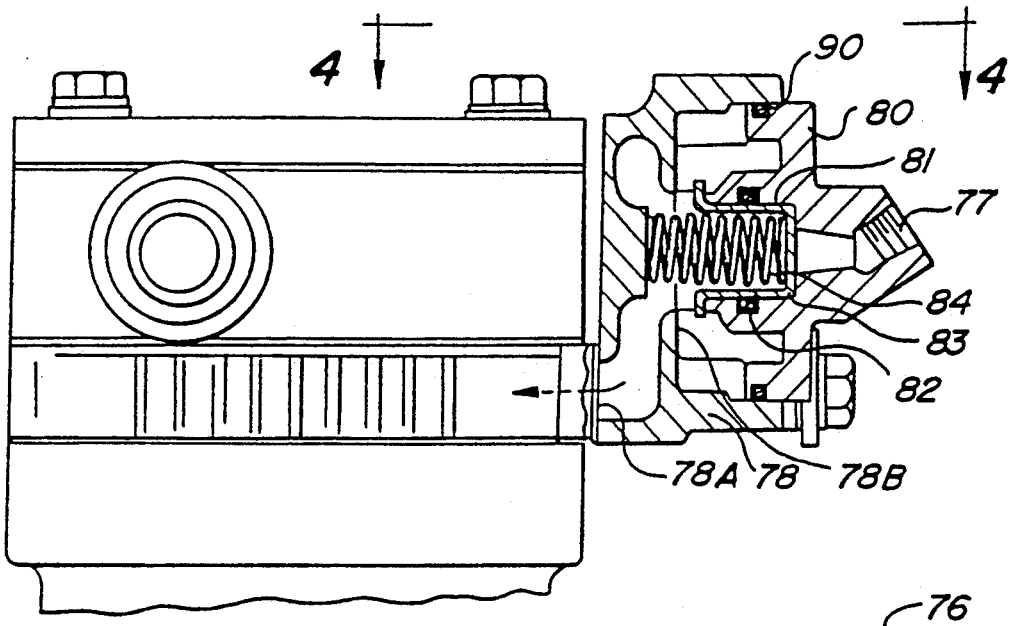
FIG. 3 is an elongated view of a cylinder head of a ring valve type air compressor similar to that shown in FIG. 1 but having an unloader device mounted on the intake thereof, said unloader device being shown in section.
Figure 4:
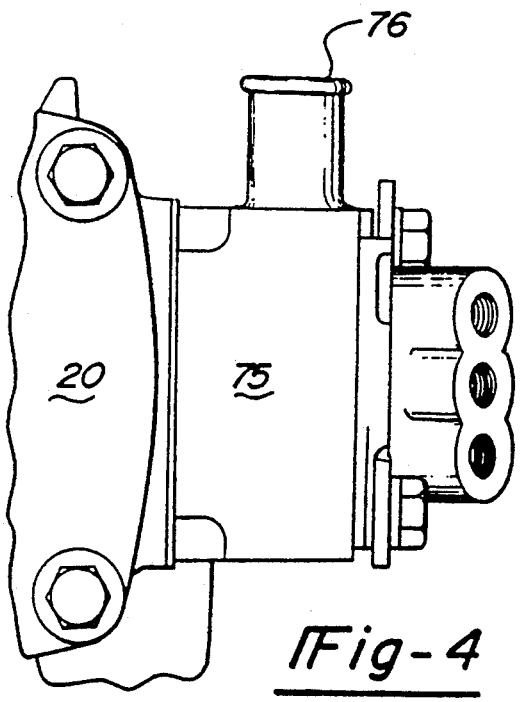
FIG. 4 is a view taken in the direction of the arrows, along the section line 4—4, of FIG. 3.

Referring to FIGS. 3 and 4, the unloading valve 75 is constructed of an air intake manifold 78 having an intake opening 78A and a central opening 78B. Air passes through the inlet 76, the central opening 78B and the intake opening 78A into the intake of the compressor when the top hat 83 is open. Mounted to the intake manifold 78 is a unloader valve body 80 sealingly connected to the intake manifold 78 by the O-ring seal 90. Provided centrally of the unloading valve body 80 is a pressurized air inlet 77 communicating with central bore 81. Sealingly mounted in the bore 81 by the rectangular seal 82 is the top hat 83.

When the compressor is to operate in its unloaded cycle, pressurized air from the unloader circuit enters the pressurized air inlet 77 and acts on the top of the top hat 83, forcing it in a downward direction against the spring 84 to cause the closing off of the central opening 78B, and thus the closing off of the intake valve of the air compressor. By means well known in the art, when it is desired to have the air compressor pumping once again, the pressure is released from the inlet 77, causing the top hat 83 to be forced in an upward direction by the spring 84 and once again clearing the path between the inlet 76 and the intake of the compressor.

Figure 13:
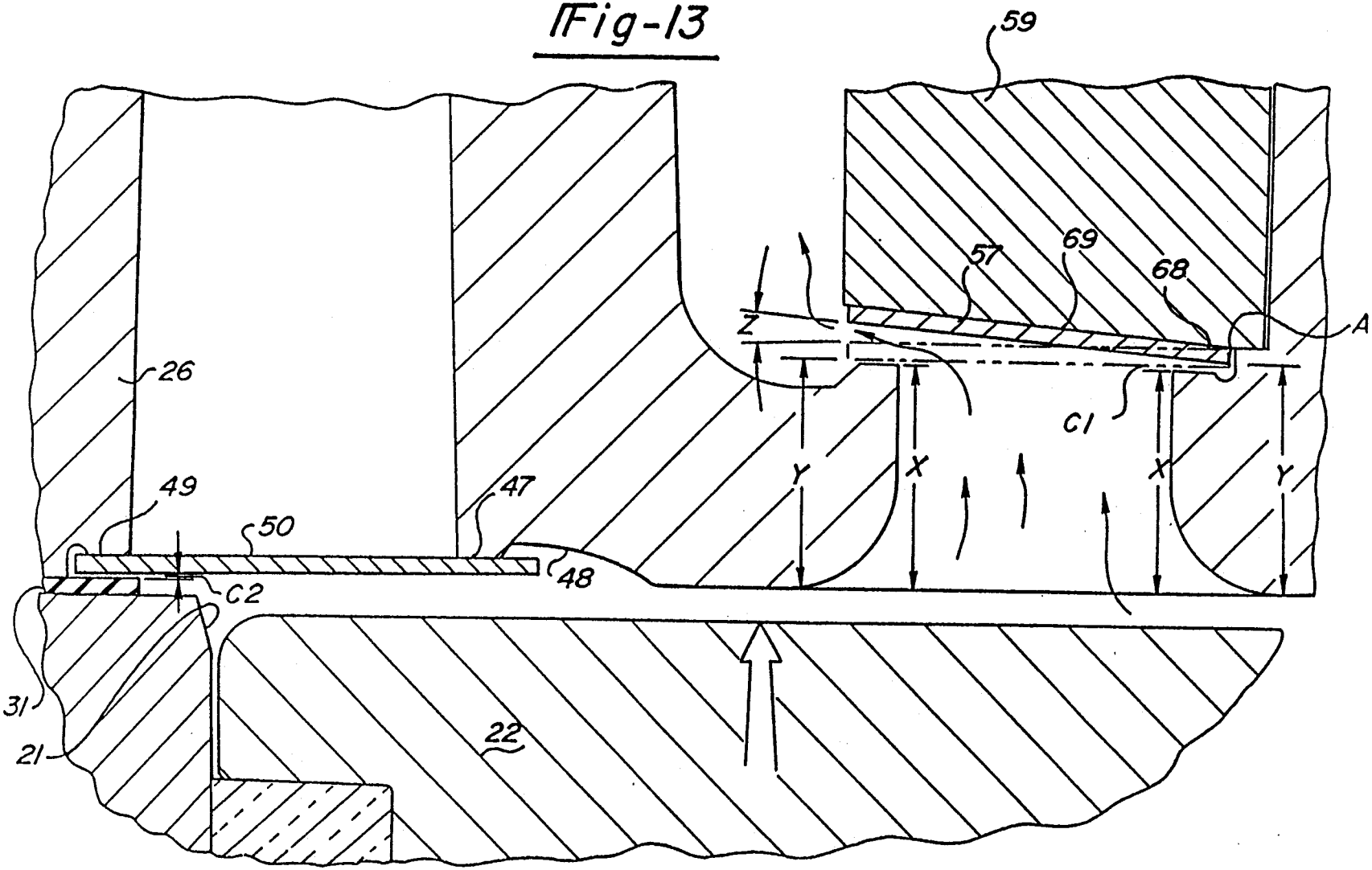
FIG. 13 is a greatly enlarged view of a portion of the valve body shown in FIGS. 8-10, showing the operating clearances of the intake ring valve and exhaust ring valve.

Referring now to FIGS. 13–16, as previously mentioned, in the most preferred embodiment of the present invention, the intake valve 50 is not held tightly between the first pair of opposing annular surfaces formed by the outer circular ridge 49 and the valve body gasket 31, but instead, is provided with a small clearance indicated by C2. FIG. 13 shows the piston 22 approaching the top of the compression stroke when the exhaust valve 57 is pressed against the tapered surface 69 of the valve retainer 59. The intake valve 50 is pressed upwardly against the inner circular ridge 47 and the outer circular ridge 49. In this position, there is the clearance C2 between the bottom of the intake valve 50 and the top of the valve body gasket 31. In a typical installation, the intake valve will be 0.015" thick and the clearance C2 will be 0.003".

Figure 14:
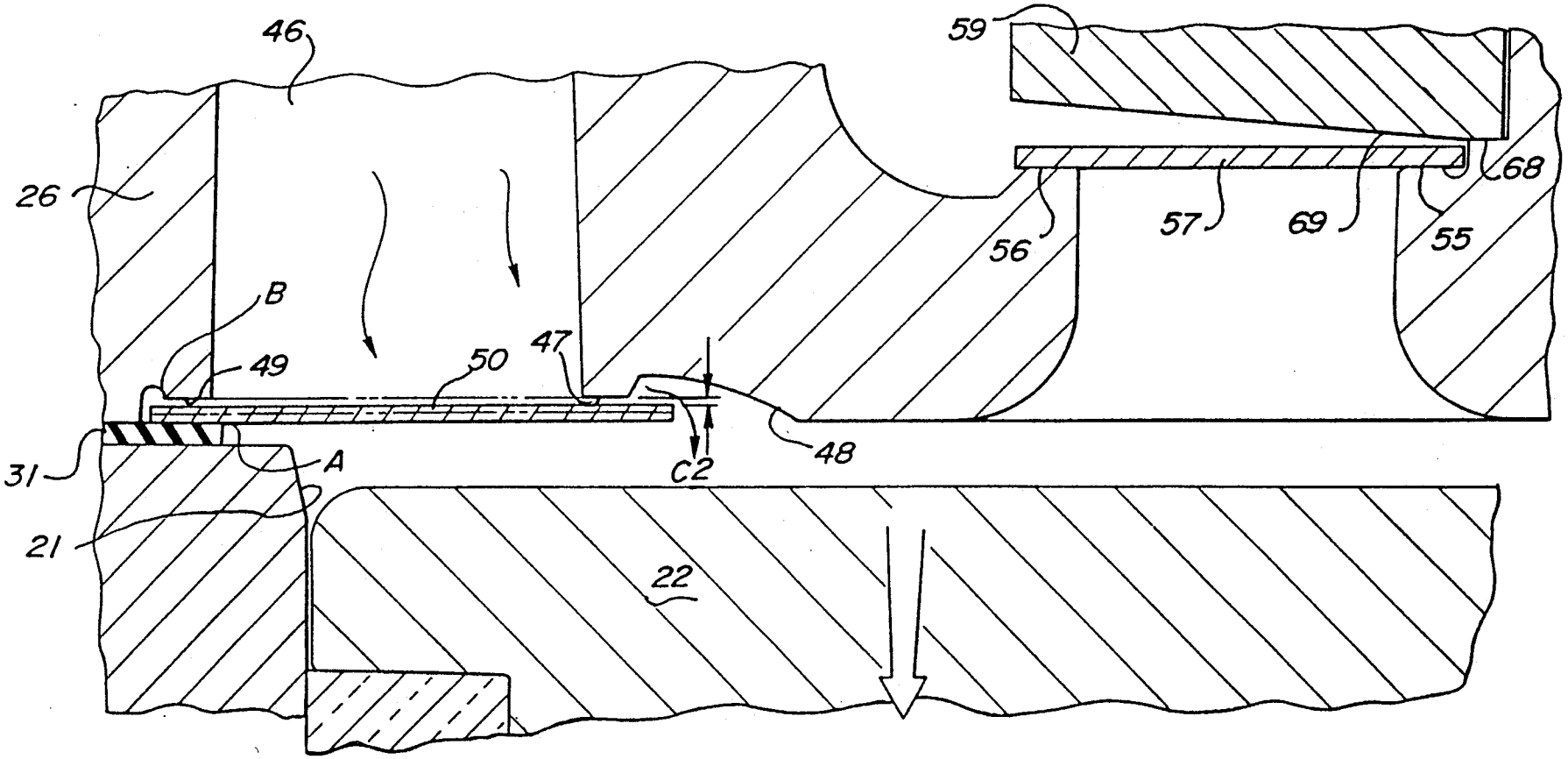
FIG. 14 is a view similar in large part to FIG. 13 but showing the piston of the fluid pump at the very beginning of its intake stroke.

Referring to FIG. 14, when the piston 22 begins its downward travel, the intake valve 50 initially will be displaced downwardly with very little force, the distance C2 of the clearance. At this time, there will have been no deformation of the valve, and the force required is very little. This is the first stage of the three stages of deflection which the intake valve undergoes.

Figure 15:
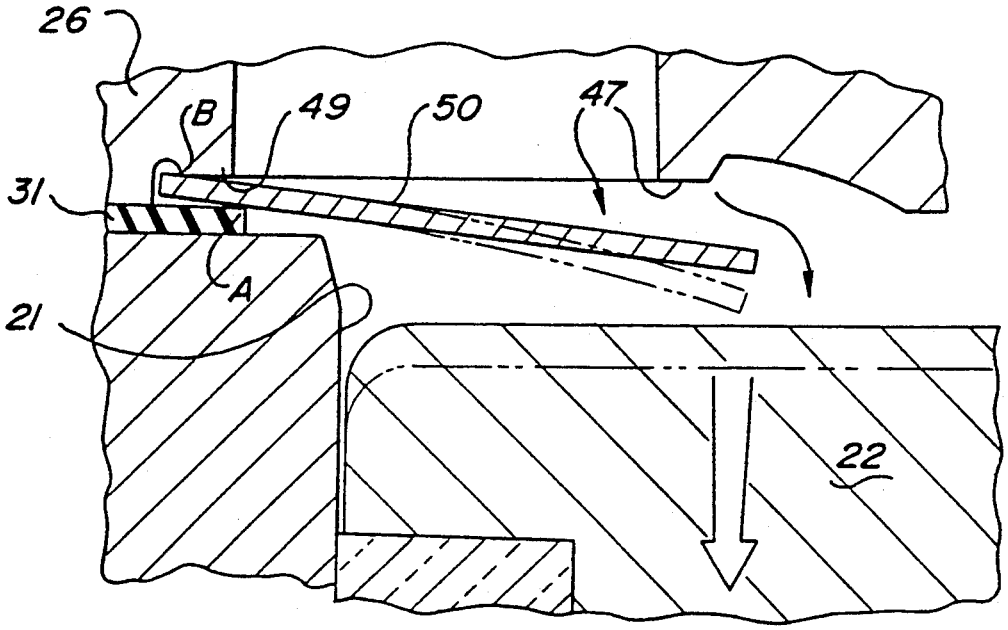
FIG. 15 is a view similar in large part to FIG. 14 but showing the piston further along on its intake stroke and illustrating the stages of deflection of the intake ring valve.
Figure 16:
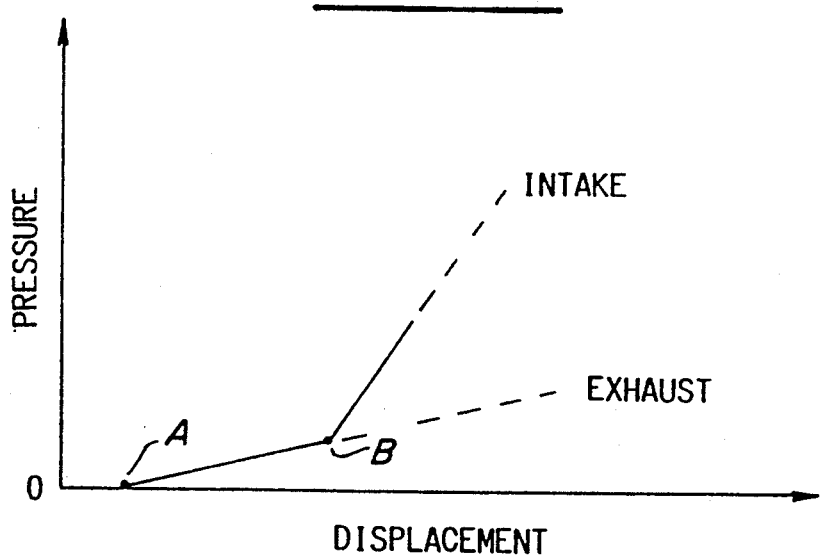
FIG. 16 is a graph of displacement versus pressure or force required to displace the ring valves.

Referring now to FIG. 15, it can be seen that the intake valve, with further downward movement of the piston 22, will start to pivot about the upper inner edge A of the valve body gasket 31 as the valve undergoes a deformation into the shape of the cone. As indicated in FIG. 16, very little force is required during the first stage of deflection to displace the valve the distance C2 to bring it into contact with edge A. Once the valve reaches edge A however, it starts to deform into the shape of a cone and a spring constant comes into effect during this second stage of deflection. Since there is no backing member to limit deflection it continues until the outer end of the ring valve 50 contacts the outer edge B of outer circular ridge 49. This will cause a second spring constant to come into effect during the third stage of deflection of the ring valve 50, indicated in phantom lines. The initial clearance provided in the first stage of deflection allows the intake valve to open very quickly. The second and third stages of deflection, having the fulcrum of said deflection at point A, not only provides for a very efficient operation of the intake valve, but prevents the "spinning" thereof by virtue of the friction between the ring valve 50 and edge A and/or B, and solves the problems present in the prior art.

Referring again to FIG. 14, the exhaust valve 57 is shown in its lower most position, resting on the second inner circular ridge 55 and the second outer circular ridge 56 which, as shown in FIG. 13, is distance X from the bottom of the compressor valve body 26.

As shown in FIG. 13, as the piston nears the end of its compression stroke, the exhaust valve has undergone a two stage deflection, first moving straight up to a distance Y from the bottom of the compressor valve body 26, which occurs when the inner peripheral edge of the exhaust valve 57 strikes the flat portion 68 of the valve retainer 59. The distance Y-X equals the clearance Cl provided in the preferred embodiment of the invention. In a typical installation, the exhaust valve will be 0.018" thick and the clearance Cl will be 0.007" nominal clearance. It should be understood that the clearance Cl for the exhaust valve and the clearance Cl for the intake valve may vary depending upon the application to which the invention is to be put.

In contrast to the unlimited deflection of the intake valve, it is important that the opening of the exhaust valve be limited so that any reverse flow through the exhaust valve will be immediately stopped to improve the volumetric efficiency of the compressor. This is especially important when the compressor is used in turbocharged applications where the pressure at the intake is greater than atmosphere. To accomplish this, the travel of the exhaust valve 57 is limited to a distance Z which occurs when the valve has sufficiently deformed into the shape of the cone to strike the tapered surface 69 of the valve retainer 59. The initial clearance C2 allows the exhaust valve to open very quickly while the limited deflection permitted stops the reverse flow immediately and improves the volumetric efficiency of the compressor. This two stage deflection is shown on FIG. 16 by the curved labeled exhaust. Point A on the curve, as before, indicates the small force required for the initial deflection.

It can easily be understood by those skilled in the art that the thicknesses of the intake and exhaust valve, the stiffness thereof, and the dimensions of the valves themselves, as well as the various dimensions of the compressor or fluid pump can vary widely and still be within the scope of the present invention. Also, the material of which the ring valves are made can vary widely and still be within the scope of the present invention. In the preferred embodiment of the present invention, the ring valves are made of steel, and the intake valve rotates (has its fulcrum) at edge A on a rubber covered valve body gasket.

Thus, by carefully analyzing problems present in the prior art air compressors, there has been provided a novel improved ring valve type air compressor which solves long standing problems in the art.

Figure 17:
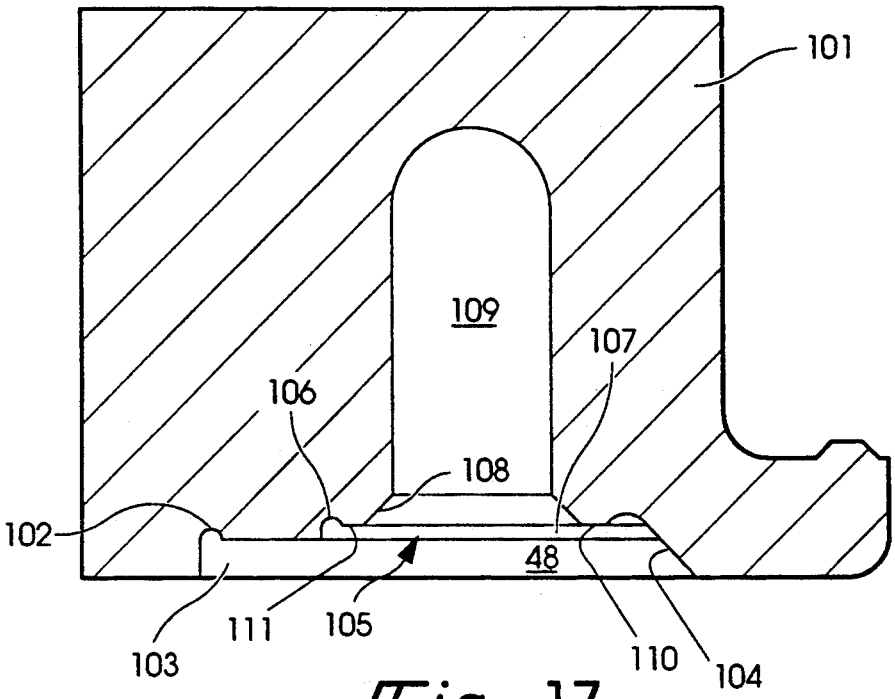
FIG. 17 is an enlarged section view of a portion of a valve body, machined for receipt of a ring valve and retainer.
Figure 18:
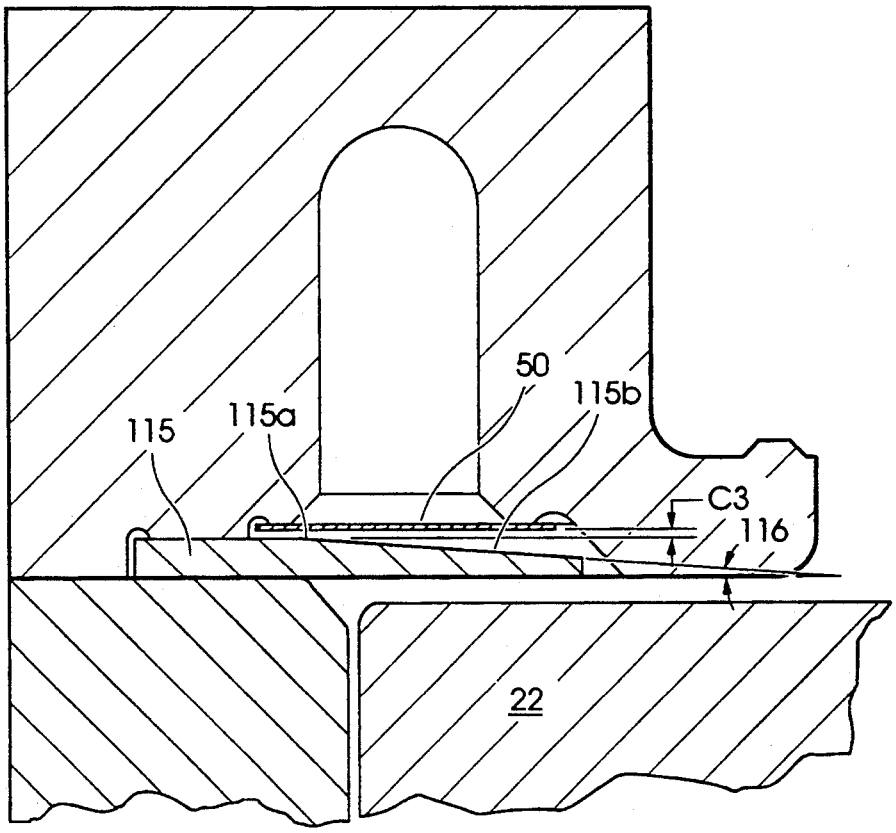
FIG. 18 is the enlarged section view of FIG. 17 with the ring valve and retainer assembled and the piston illustrated.

Referring to FIGS. 17 and 18 another intake valve embodiment of the present invention is illustrated. The embodiments of FIGS. 13 and FIG. 17–18 are similar in a number of respects and many of the same components, surfaces and features appear in FIGS. 17–18 as they appear in FIG. 13. The primary difference between the FIG. 13 embodiment and the embodiment of FIGS. 17–18 resides in the removal of valve body gasket 31 and the addition of an intake valve retainer. In order to accommodate the retainer the compressor valve body has been modified to the illustrated compressor valve body 101 of FIG. 17.

Referring more specifically to compressor valve body 101, there is a first circular relief channel 102 and a corresponding annular ring recess 103 which extends radially inwardly to surface 104 of relief area 48. The ring valve relief area 105 is disposed concentric with and immediately above recess 103. Area 105 includes a circular relief channel 106 and an annular ring recess 107. Recess 107 extends radially inwardly to surface 104 of relief area 48. The base of gallery 46 (FIG. 13) has been expanded in FIG. 17 by the addition of conical surface 108 which in combination with recess 107 helps to define gallery 109. The bottom face of gallery 109 is further defined in part by inner circular ridge 110 and outer circular ridge 111.

Referring to FIG. 18, ring or intake valve 50 and intake valve retainer 115 are illustrated as assembled into the compressor valve body. Retainer 115 has an annular ring shape and an approximate four degree downward taper from fulcrum edge 115*a* along surface 115*b* as the retainer extends radially inwardly. This four degree taper is defined by angle 116. Retainer 115 is sized so as to assemble with either a line-to-line fit or with a very slight clearance fit within annular ring recess 103. The outside diameter of retainer 115 is likewise sized for the retainer to fit closely within recess 103 and for it to extend below relief channel 102. Radially outwardly of fulcrum edge 115*a* the cross sectional shape retainer is generally rectangular. Radially inwardly the cross sectional shape is tapered. The thickness of intake valve 50 is sized for the valve to fit within recess 107. The outside diameter of intake valve 50 is such that the valve extends radially to a location beneath the circular relief channel 106.

As piston 22 approaches the top of the compression stroke, clearance C3, as illustrated in FIG. 18, is created between the bottom of the intake valve and the top of the intake valve retainer 115. The internal pressure forces the intake valve 50 upwardly where it is pressed against inner circular ridge 110 and outer circular ridge 111.

Figure 19:
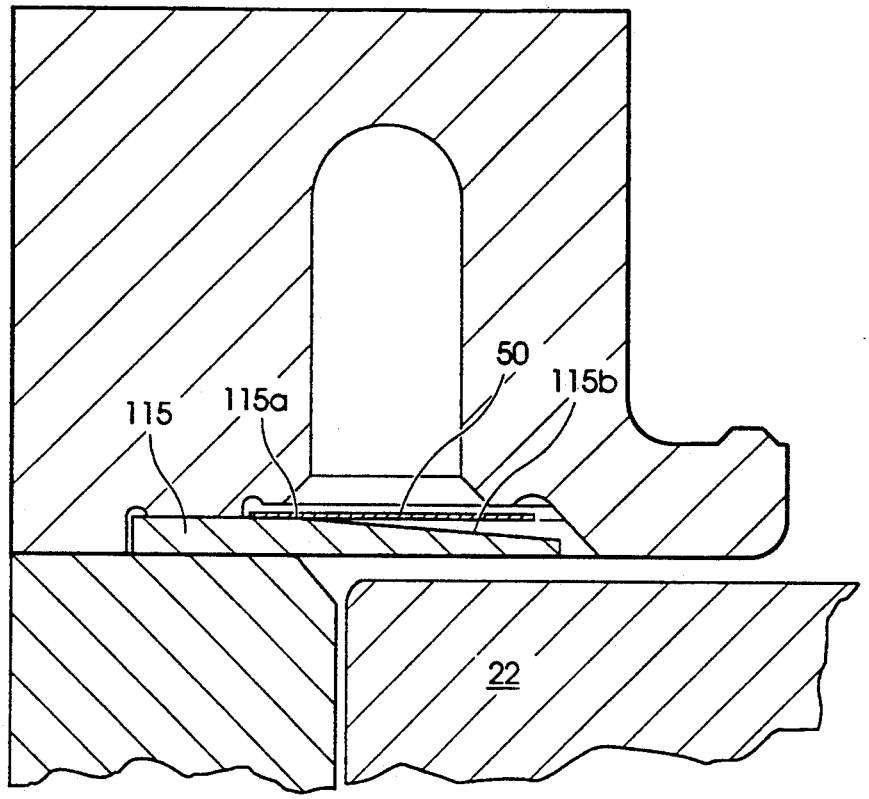
FIG. 19 is the enlarged section view of FIG. 18 after the ring valve undergoes its first stage of vertical movement.

Referring to FIG. 19 the initial movement of intake valve 50 is illustrated. When the piston 22 begins it downward travel, the intake valve 50 will initially be displaced downwardly with very little force, traveling the distance C3 of the clearance. At this time there will be no deformation of intake valve 50 and the force required to effect the movement across clearance C3 is very slight. This initial movement is the first stage of the two stages of movement/deflection which the intake valve undergoes in the embodiment of FIGS. 17–18.

Figure 20:
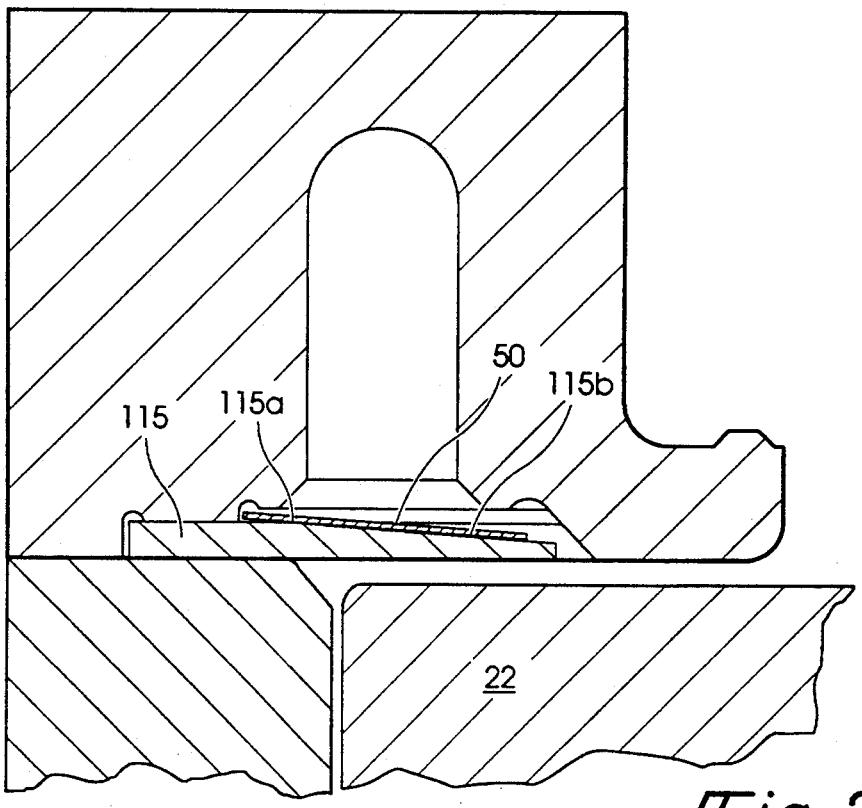
FIG. 20 is the enlarged section view of FIG. 19 after the ring valve deflects into a frustoconical form against the retainer.

Referring to FIG. 20 the second stage of movement/deflection which the intake valve undergoes is illustrated. With further downward movement of the piston 22, the force acting on intake valve 50 increase causing the inner portion of the valve to deflect downwardly and the outer radial edge of the valve to pivot upwardly about retainer edge 115*a*. The four degree taper provides clearance for the downward deflection of the intake valve thereby enabling relatively free deflection without pinching or binding of the intake valve which might cause wear. This relatively free deflection also occurs without deformation of the intake valve.

The intake valve 50 will ultimately lay against retainer surface 115*b* and in this orientation the valve has the shape of a cone (actually truncated). The position of edge 115*a* relative to the thickness of valve 50 and the size of area 105 and relief channel 106 are such that the outer radial edge of the intake valve has freedom to move upwardly a sufficient distance to preclude any deformation of the intake valve. There is thus only a two stage movement/deflection in this embodiment (FIG. 18) as compared to the three stages of the earlier embodiment (FIG. 13).

In general the remainder of the FIG. 17–18 embodiment is the same as that of FIG. 13. The intake valve performs very efficiently, there are not any unacceptable flow restrictions, and there is no unacceptable "spinning." In the FIG. 17–18 embodiment the exhaust valve operates in the same fashion as in the earlier embodiment of FIG. 13.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A ring valve assembly for use in a reciprocating type fluid pump with a piston cylinder and a cylinder head, said valve assembly including:

a) a ring valve having a fluid seal surface for selectively closing a fluid passage of a cylinder head; and b) bias means for said ring valve for urging said ring valve in a first direction, wherein said bias means includes the outer peripheral edge region of said ring valve being secured between opposing upper and lower annular surfaces formed by said cylinder head and said piston cylinder with a predetermined small clearance, said upper annular surface including an outer edge and said lower annular surface including an inner edge which defines a fulcrum radially inward of said outer edge;

wherein said ring valve undergoes at least two stages of movement and deflection during operation, said ring valve being vertically displaced a distance equal to said predetermined small clearance against only one of said upper or lower annular surface during one of said two stages of movement and deflection and said ring valve pivoting about said inner edge and deforming into the shape of cone about said fulcrum in the other of said two stages of movement and deflection.

2. The ring valve assembly defined in claim 1, wherein said opposing upper and lower annular surfaces are further formed by a valve body gasket sealingly retained between said piston cylinder and said cylinder head.

3. The ring valve assembly defined in claim 2, wherein said upper annular surface is formed by a compressor valve body forming part of said cylinder head.

4. The ring valve assembly defined in claim 3, wherein said lower annular surface is formed by said valve body gasket.

5. The ring valve assembly defined in claim 1, and further including:

a) a second ring valve with a second fluid seal surface for selectively closing a second fluid passage of a cylinder head; and b) second bias means for said second ring valve for urging said second ring valve in a second direction, wherein said second bias means includes the inner peripheral region of said second ring valve being secured in said cylinder head between a second pair of opposing upper and lower annular surfaces formed by a valve retainer and said cylinder head with a second predetermined small clearance, whereby said second ring valve undergoes at least two stages of movement and deflection during operation, said second ring valve being vertically displaced a distance equal to said second predetermined small clearance in one of said two stages of movement and deflection and said second ring valve deforming into the shape of a cone against said second upper annular surface in the other of said two stages of movement and deflection.

6. A valve assembly and reciprocating fluid pump having a piston cylinder, and a cylinder head secured to said piston cylinder, defining a fluid chamber, said valve assembly comprising:

a) a first ring valve with a seal surface on one side thereof disposed adjacent to said cylinder head to selectively engage a seat means on said cylinder head and close at least one fluid passage through said cylinder head; and b) bias means for allowing said first ring valve to seal against said seat means on said cylinder head, wherein said bias means include the outer peripheral edge region of said first ring valve being positioned between opposing upper and lower annular surfaces formed by said cylinder head and said piston cylinder with a predetermined small clearance, said upper annular surface including an outer edge and said lower annular surface including an inner edge which defines a fulcrum radially inward of said outer edge;

whereby said first ring valve undergoes at least two stages of movement and deflection during operation, said first ring valve being vertically displaced a distance equal to said predetermined small clearance against only one of said upper lower annular surfaces in one of said two stages of movement and deflection and said first ring valve pivoting about said inner edge and deforming into the shape of a cone about said fulcrum in the other of said two stages of movement and deflection.

7. The valve assembly defined in claim 6, wherein said opposing upper and lower annular surfaces are further formed by a valve body gasket sealingly retained between said piston cylinder and said cylinder head.

8. The valve assembly defined in claim 6, further including a circular gallery formed on said cylinder head which is defined between a first inner and a first outer circular ridge, said first inner and said first outer circular ridges providing first valve seat means on said cylinder head, whereby said gallery improves fluid flow through said valve assembly by distributing the fluid flow along said first valve seat means to be opened and closed by said ring valve.

9. The valve assembly defined in claim 8, wherein said fluid pump is a gas compressor and said fluid chamber is a compression chamber.

10. The valve assembly defined in claim 9, wherein said cylinder head and said first valve seat means are composed of a high silicon and aluminum alloy with more than 11 percent silicon for increased wear resistance.

11. The valve assembly defined in claim 6, wherein said at least one fluid passage is an intake passage, and said first ring valve further undergoes a third stage of deflection during operation in which the outer peripheral edge region of said ring valve is restrained between said inner edge and said outer edge of said lower and upper annular surfaces, respectively, thereby increasing the stiffness of said intake valve.

12. The valve assembly defined in claim 11, and further comprising a second ring valve disposed coaxially with said first ring valve and adjacent to said cylinder head on the side opposite to said fluid chamber for selectively closing an exhaust passage provided through said cylinder head, and a second bias means for urging said ring valve to a closed position with respect to said exhaust passage, wherein said second bias means for said second ring valve includes the inner peripheral edge of said second ring valve being positioned between a second pair of opposing upper and lower annular surfaces formed by a valve retainer and said cylinder head with a second predetermined small clearance, whereby said second predetermined small clearance in one of said two stages of movement and deflection and said second ring valve deforming into the shape of a cone against said second upper annular surface in other of said two stages of movement and deflection.

13. The fluid pump defined in claim 12, and including an external unloading device for said fluid pump.

14. The device defined in claim 13, wherein said external unloading device includes:

a) an air intake manifold sealingly mounted over the intake of said fluid pump and having an intake opening and a central opening;

b) an unloading valve body sealingly connected to said intake manifold having a central bore and an air inlet communicating with said central bore;

c) a top hat unloader sealingly mounted in said bore; and d) a spring biasing means to bias said top hat to a normally open position.

15. A ring valve assembly for use in a reciprocating type fluid pump with a piston cylinder and cylinder head, said valve assembly including:

a) a ring valve having a fluid seal surface for selectively closing a fluid passage of a cylinder head; and b) bias means for said ring valve for urging said ring valve in a first direction, wherein said bias means includes the outer peripheral edge region of said ring valve being secured between opposing upper and lower annular surfaces formed by a retainer means and said piston cylinder with a predetermined small clearance; and c) said retainer means having a fulcrum edge and tapered surface and being disposed beneath said ring valve for providing deflection clearance for said ring valve about said fulcrum edge.

16. A valve assembly and reciprocating fluid pump having a piston cylinder, and a cylinder head secured to said piston cylinder, defining a fluid chamber, said valve assembly comprising:

a) a ring valve with a seal surface on one side thereof disposed adjacent to said cylinder head to selectively engage a seat means on said cylinder head and close at least one fluid passage through said cylinder head; and b) retainer means having a fulcrum edge and tapered surface and being disposed beneath said ring valve for providing deflection clearance for said ring valve about said fulcrum edge, said ring valve being positioned between opposing annular surfaces with a predetermined small clearance, whereby said ring valve will undergo a first stage displacement in the vertical direction equal to said predetermined small clearance followed by a second stage deflection about said fulcrum edge during operation.

* * * * *

UNITED STATES PATENT AND TRADEMARK OFFICE

CERTIFICATE OF CORRECTION

PATENT NO. : 5,277,560

DATED : January 11, 1994

INVENTOR(S) : Nathan Ritchie, et al

It is certified that error appears in the above-indentified patent and that said Letters Patent is hereby corrected as shown below:

In item 56 of the title page, the inventor's name of "Merzmark" is misspelled. It should read --Herzmark--.

In column 12, line 50, please insert --ring valve undergoes two stages of movement and deflection during operation, said second ring valve being vertically displaced a distance equal to said second-- before "predetermined".

In column 12, line 53, please insert --the-- before the word "other".

Signed and Sealed this

Twenty-fourth Day of May, 1994

Bruce Lehman

*Attest:*

BRUCE LEHMAN

*Attesting Officer*

*Commissioner of Patents and Trademarks*